US010571849B2

(12) United States Patent
Yamamoto et al.

(10) Patent No.: US 10,571,849 B2
(45) Date of Patent: Feb. 25, 2020

(54) IMAGE FORMING APPARATUS FOR SUPPRESSING DISCHARGED PAPER ADHESION

(71) Applicant: CANON KABUSHIKI KAISHA, Tokyo (JP)

(72) Inventors: Satoru Yamamoto, Noda (JP); Toshiyuki Miyake, Nagareyama (JP); Katsuya Nakama, Nagareyama (JP); Koji Yumoto, Toride (JP); Riki Fukuhara, Kashiwa (JP); Akihiro Kawakita, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 15/902,153

(22) Filed: Feb. 22, 2018

(65) Prior Publication Data

US 2018/0246459 A1 Aug. 30, 2018

(30) Foreign Application Priority Data

Feb. 27, 2017 (JP) ..... 2017-035111

(51) Int. Cl.
*G03G 15/00* (2006.01)
*G03G 21/00* (2006.01)
(Continued)

(52) U.S. Cl.
CPC ..... *G03G 15/70* (2013.01); *B65H 29/50* (2013.01); *B65H 29/683* (2013.01); *B65H 43/00* (2013.01); *G03G 15/5029* (2013.01); *G03G 15/6573* (2013.01); *G03G 15/2003* (2013.01); *G03G 15/5062* (2013.01);
(Continued)

(58) Field of Classification Search
CPC ..... B65H 29/50; B65H 29/683; B65H 31/04; B65H 31/08; B65H 43/00; G03G 15/00; G03G 15/2003; G03G 15/5029; G03G 15/5062; G03G 15/6573; G03G 15/70; G03G 21/00; G03G 2215/00067; G03G 2215/00556; G03G 2215/00616
See application file for complete search history.

(56) References Cited

U.S. PATENT DOCUMENTS 7,938,388 B2 5/2011 Fujii et al.
8,285,193 B2 * 10/2012 Saeki ..... G03G 15/6573 399/33
(Continued)

FOREIGN PATENT DOCUMENTS

JP 2006-232484 A 9/2006
JP 2007-022691 A 2/2007

*Primary Examiner* — Nguyen Q. Ha
(74) *Attorney, Agent, or Firm* — Venable LLP

(57) ABSTRACT

An image forming apparatus comprises a first conveyance unit, an image forming unit, a second conveyance unit, a stacking unit, and a control unit. The control unit controls, in a case where a sheet stacking condition of the stacking unit does not satisfy a predetermined stacking condition, the second conveyance unit to convey the sheet at a second conveyance speed that is faster than the first conveyance speed. The control unit controls, in a case where the sheet stacking condition of the stacking unit satisfies the predetermined stacking condition, the second conveyance unit to convey the sheet at a third conveyance speed that is slower than the second conveyance speed.

15 Claims, 6 Drawing Sheets

(51) Int. Cl.

| | |
|---|---|
| ***B65H 31/08*** | (2006.01) |
| ***B65H 29/50*** | (2006.01) |
| ***B65H 43/00*** | (2006.01) |
| ***B65H 29/68*** | (2006.01) |
| *G03G 15/20* | (2006.01) |

(52) U.S. Cl.
CPC ..... *G03G 2215/00067* (2013.01); *G03G 2215/00556* (2013.01); *G03G 2215/00616* (2013.01)

(56) References Cited

U.S. PATENT DOCUMENTS

| | | | | |
|---|---|---|---|---|
| 8,393,372 | B2 | 3/2013 | Yamauchi et al. | |
| 8,413,978 | B2 | 4/2013 | Watanabe et al. | |
| 8,628,073 | B2 | 1/2014 | Watanabe et al. | |
| 2006/0214974 | A1* | 9/2006 | Isobe | B41J 29/377 347/18 |
| 2009/0028587 | A1* | 1/2009 | Hanashi | G03G 15/234 399/27 |
| 2010/0247203 | A1 | 9/2010 | Watanabe et al. | |
| 2012/0099876 | A1* | 4/2012 | Kikuchi | G03G 15/6573 399/16 |
| 2012/0201586 | A1* | 8/2012 | Saeki | G03G 15/6573 399/405 |
| 2014/0020533 | A1 | 1/2014 | Watanabe et al. | |
| 2015/0346633 | A1* | 12/2015 | Megawa | G03G 15/6529 358/1.1 |
| 2016/0363901 | A1* | 12/2016 | Arakawa | G03G 15/6576 |
| 2017/0082958 | A1* | 3/2017 | Hasebe | G03G 15/2028 |

* cited by examiner

IMAGE FORMING APPARATUS FOR SUPPRESSING DISCHARGED PAPER ADHESION

BACKGROUND OF THE INVENTION

Field of the Invention

The present invention relates to an image forming apparatus for suppressing discharged paper adhesion.

Description of the Related Art

An image forming apparatus of an electrophotographic type or the like forms images by using heat. Since glossiness (gloss) of a toner image changes in accordance with a heat amount, the heat amount supplied to the toner image is controlled in accordance with a gloss designated by an operator. Also, if, prior to a toner image sufficiently cooling after being formed on a preceding sheet, a succeeding sheet is stacked on top of the preceding sheet, the toner image on the preceding sheet will adhere to the succeeding sheet. This is referred to as discharged paper adhesion. According to Japanese Patent Laid-Open No. 2006-232484, by stacking a sheet on a post-processing apparatus positioned farthest from an image forming apparatus among a plurality of post-processing apparatuses, adhesion of a toner image is suppressed. According to Japanese Patent Laid-Open No. 2007-022691, by discharging a sheet via a longest conveyance path among a plurality of conveyance paths whose lengths differ, adhesion of a toner image is suppressed.

In the image forming apparatus of Japanese Patent Laid-Open No. 2006-232484, when an operator selects a discharging destination that is close to an image forming apparatus, discharged paper adhesion cannot be suppressed. In the image forming apparatus of Japanese Patent Laid-Open No. 2007-022691, it is necessary to prepare a plurality of conveyance paths for the same discharging destination, and manufacturing costs increase.

SUMMARY OF THE INVENTION

Accordingly, the present invention efficiently reduces discharged paper adhesion.

The present invention provides an image forming apparatus comprising: a first conveyance unit configured to convey a sheet at a first conveyance speed; an image forming unit configured to form a toner image on the sheet conveyed at the first conveyance speed by the first conveyance unit; a second conveyance unit configured to convey the sheet discharged from the image forming unit; a stacking unit configured to stack the sheet conveyed by the second conveyance unit; a control unit configured to control, in a case where a sheet stacking condition of the stacking unit does not satisfy a predetermined stacking condition, the second conveyance unit to convey the sheet at a second conveyance speed that is faster than the first conveyance speed, and in a case where the sheet stacking condition of the stacking unit satisfies the predetermined stacking condition, the second conveyance unit to convey the sheet at a third conveyance speed that is slower than the second conveyance speed.

Further features of the present invention will become apparent from the following description of exemplary embodiments (with reference to the attached drawings).

DESCRIPTION OF THE EMBODIMENTS

Figure 1:
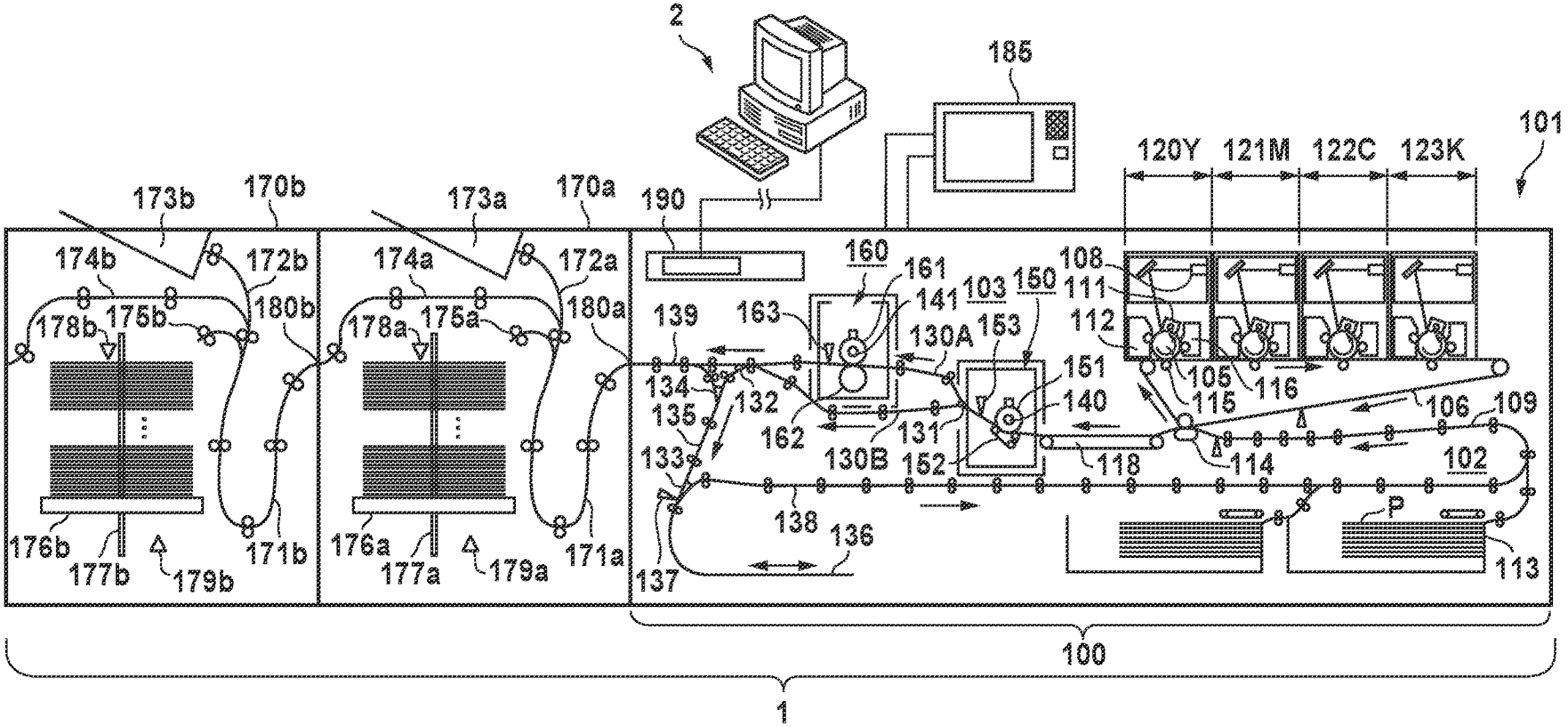
FIG. 1 is a cross-sectional view illustrating an image forming system.

FIG. 1 illustrates an overview configuration of an image forming system 1. The image forming system 1 has an image forming apparatus 100, a first stacker 170*a*, and a second stacker 170*b*. Note that since the first stacker 170*a* and the second stacker 170*b* have common functions, the characters "a" and "b" are added to the end of the reference numerals when distinguishing the functions of the two.

Image Forming Apparatus

The image forming apparatus 100 comprises an operation unit 185. By the operation unit 185, for example, an operator designates an amount of gloss of a toner image, and performs an operation when designating a discharging destination of a sheet P. Within the image forming apparatus 100, each mechanism for configuring an engine unit 101 and an engine controller 190 is provided. The engine controller 190 is connected to a PC 2 via a network. The PC 2 is an external host apparatus for generating print jobs. The PC is an abbreviation for personal computer, but it is a term that encompasses computers such as a server, a digital camera, a smart phone or the like.

The first stacker 170*a* is a sheet stacking apparatus connected to the image forming apparatus 100, and is one discharging destination of the sheet P. A discharge port of the image forming apparatus 100 faces a loading port 180*a* of the first stacker 170*a*. The second stacker 170*b* is a sheet stacking apparatus connected to the first stacker 170*a*, and is one discharging destination of the sheet P. The second stacker 170*b* receives the sheet P from the image forming apparatus 100 via the first stacker 170*a*. A discharge port of the first stacker 170*a* faces a loading port 180*b* of the second stacker 170*b*.

The engine unit 101 has four image forming stations 120, 121, 122, and 123 for respectively forming toner images. The image forming stations 120, 121, 122, and 123 have an image carrier 105, a charger 111, an exposure unit 108, a developer 112, a primary transfer unit 115, and a cleaner 116. The image carrier 105 is a photosensitive drum and carries an electrostatic latent image and a toner image. The charger 111 is a charging unit for causing the image carrier 105 to be uniformly charged. The exposure unit 108 is an exposure unit or a scan unit for forming an electrostatic latent image by exposing the image carrier 105 after it is charged uniformly. The developer 112 is a developer unit for forming a toner image by developing an electrostatic latent image using toner. The primary transfer unit 115 is a primary transfer unit for a primary transfer of toner image to an intermediate transfer belt 106.

A conveyance unit 102 conveys the sheet P along a conveyance path. The conveyance unit 102 feeds the sheet P to a conveyance path 109 by separating one sheet at a time from a storage 113, and further conveys the sheet P along the conveyance path 109. In this way, the conveyance path 109 is a conveyance path that extends from the storage 113 to a first fixing device 150. The intermediate transfer belt 106 and a secondary transfer body 114 form a secondary transfer unit. The secondary transfer unit is a secondary transfer unit for secondary transferring, onto the sheet P, a toner image after it is conveyed by the intermediate transfer belt 106. A conveyance apparatus 118 includes a conveyer belt on which the sheet P is conveyed to a fixing unit 103 after being discharged from the secondary transfer unit.

The fixing unit 103 has the first fixing device 150 and a second fixing device 160 for causing the toner image to be fixed to the sheet P by supplying heat and pressure to the sheet P and the toner image. A heater 140 provided on a fixing roller 151 of the first fixing device 150 is a heat source for generating the heat supplied to the sheet P and the toner image. A pressure belt 152 adds pressure to the sheet P and the toner image by sandwiching the sheet P and the toner image in cooperation with the fixing roller 151. A first fixation sensor 153 is a sheet sensor for detecting fixing completion. The second fixing device 160 is arranged downstream of the first fixing device 150 in the direction that the sheet P is conveyed. The second fixing device 160 is an auxiliary fixing device for adding gloss to the toner image on the sheet P after it is fixed by the first fixing device 150 and ensuring a fixing characteristic. The second fixing device 160, similarly to the first fixing device 150, has a heater 141, a fixing roller 161, a pressure roller 162, and a second fixation sensor 163. There are cases where the engine controller 190 is instructed, through the operation unit 185, to add more gloss to the sheet P. Also, there are times where the type of the sheet P is a type such as a thick paper that requires a greater heat amount for toner image fixation. In such cases, the engine controller 190 guides the sheet P to a conveyance path 130A by a first flapper 131 after it passes through the first fixing device 150, and further conveys it to the second fixing device 160. Depending on the type of the sheet P, there may be no need to pass it through the second fixing device 160. In such a case, the engine controller 190 guides the sheet P to a conveyance path 130B by the first flapper 131. In other words, the sheet P does not pass through the second fixing device 160. In cases where the sheet P is normal paper or thin paper and in cases where there is no setting for adding a lot of gloss, the sheet P is conveyed through the conveyance path 130B after it has passed through the first fixing device 150.

A second flapper 132 is provided at the confluence of the conveyance path for conveying the sheet P after it is discharged from the second fixing device 160 and the conveyance path 130B. The second flapper 132 is a member for guiding, to a conveyance path 135 or to a conveyance path 139, the sheet P after it has passed through the second fixing device 160 or after it is conveyed through the conveyance path 130B. The sheet P is discharged to the exterior of the image forming apparatus 100 after it is conveyed over the conveyance path 139. The leading edge of the sheet P guided to the conveyance path 135 passes an inversion sensor 137, and the sheet P is conveyed to an inversion unit 136. Because the direction in which the sheet P is conveyed is reversed by the inversion unit 136, the inversion unit 136 may also be referred to as a switchback conveyance path. When the inversion sensor 137 detects the trailing edge of the sheet P, the engine controller 190 switches the direction in which the sheet P is conveyed. A third flapper 133 is provided at the divergence of the conveyance path 135 into the inversion unit 136 and a conveyance path 138. The engine controller 190 guides the sheet P to the conveyance path 138 by controlling the third flapper 133 in a case where an image is formed on a second side of the sheet P after an image is formed on a first side of the sheet P. In a case where the sheet P is guided to the conveyance path 138, the sheet P is guided to the secondary transfer unit again through the conveyance path 109, and an image is formed on the second side by the secondary transfer unit. Meanwhile, in a case where a face down discharge is instructed, the engine controller 190 guides the sheet P to the conveyance path 135 by controlling the third flapper 133. A face down discharge means that discharge is such that the first side on which a toner image is formed ends up face down. The engine controller 190, by controlling a fourth flapper 134, guides the sheet P to the conveyance path 139 after the switchback conveyance through the conveyance path 135. The sheet P after being conveyed through the conveyance path 139 is discharged from the image forming apparatus 100, and handed over to the loading port 180*a* of the first stacker 170*a*.

Sheet Stacking Apparatuses

The first stacker 170*a* is a stacking apparatus that conveys the sheet P through a conveyance path 171*a*, discharges it from a discharge port 175*a*, and stacks it on a lift table 176*a*. The lift table 176*a* can move up or down by an elevating mechanism 177*a*. The elevating mechanism 177*a* causes the position of the lift table 176*a* to change in accordance with the size of the stack of sheets P. In other words, the elevating mechanism 177*a* adjusts the position of the lift table 176*a* so that the height of the sheet P that is positioned topmost among the sheets that are stacked on the lift table 176*a* is aligned with the discharge port 175*a*. A paper surface sensor 178*a* is a sheet sensor for detecting the sheet P that is positioned topmost. A lower limit sensor 179*a* is a sensor for detecting that the lift table 176*a* is positioned at a lower limit in the up/down movement range of the lift table 176*a*. The engine controller 190, for example, resets a count value for counting a drive distance of the elevating mechanism 177*a* when the lower limit sensor 179*a* detects the lift table 176*a*. By this, it is possible for the engine controller 190 to recognize the position of the lift table 176*a*. The count value may be a number of pulse signals supplied to a pulse motor included in the elevating mechanism 177*a*. The first stacker 170*a* may have a tray 173*a*. The engine controller 190 discharges the sheet P temporarily onto the tray 173*a*. By this, the operator can check the image formed on the sheet P. Note that the sheet P is discharged to the tray 173*a* through a conveyance path 172*a* that diverges from the conveyance path 171*a*. The first stacker 170*a* may transfer the sheet P to the second stacker 170*b* which is connected to the downstream side with respect to the first stacker 170*a* through a conveyance path 174*a*. In this way, the sheet stacking apparatus is extended by linking a plurality of stackers sequentially. For example, when the first stacker 170*a* becomes full, the sheet P may be conveyed to the second stacker 170*b*. Consequently, the image forming apparatus 100 is enabled to form images consecutively on more sheets P. Note that description in regards to the configuration of the second stacker 170*b* is abbreviated since it is similar to the first stacker 170*a*. In FIG. 1, "b" is added to the end of the reference numerals for constituent components of the second stacker 170*b*, and description of the constituent component in the first stacker 170*a* is invoked.

<Engine Controller>

Figure 2:
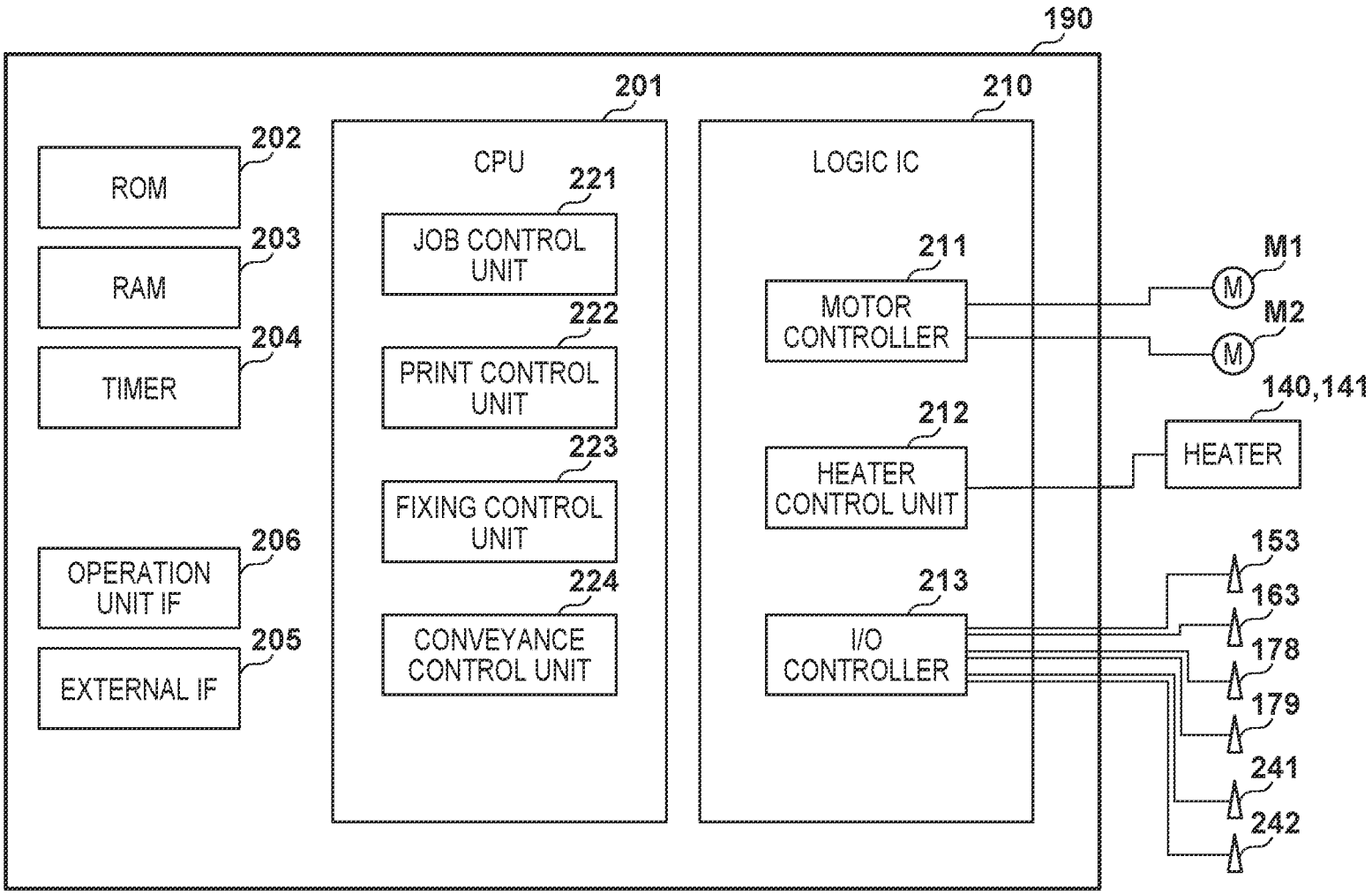
FIG. 2 is a block diagram illustrating a control system.

FIG. 2 is a block diagram illustrating functions of the engine controller 190. A CPU 201 is a central processing unit for controlling the image forming system 1 comprehensively. A ROM 202 is a storage apparatus for storing control programs and data. A RAM 203 is a storage apparatus for holding setting values needed for control. A timer 204 is a counter circuit, a real-time clock, or the like, for measuring time. An external IF 205 is a communication circuit for communicating with the PC 2 or the like via a network. An operation unit IF 206 is an interface for communicating with the operation unit 185, receiving instructions inputted from the operation unit 185, and causing the operation unit 185 to display information. A logic IC 210 is a logical circuit that has various control functions.

The CPU 201 realizes various functions by executing control programs. Some or all of these functions may be realized by a hardware circuit such as an ASIC or an FPGA that cooperates with the CPU 201. ASIC is one example of an application specific integrated circuit. FPGA is an abbreviation for field-programmable gate array. Functions of the logic IC 210 may be realized by the CPU 201. When a job control unit 221 receives a print job it analyzes the print job and also generates an image signal by extracting image data attached to the print job. A print control unit 222 controls the image forming stations 120, 121, 122, and 123. A fixing control unit 223 controls the heaters 140 and 141 via a heater control unit 212. A conveyance control unit 224 controls a conveyance roller within the image forming apparatus 100 through a motor controller 211, a conveyance roller within the first stacker 170*a*, a conveyance roller within the second stacker 170*b*, or the like.

The motor controller 211, the heater control unit 212, and an I/O controller 213 are arranged in the logic IC 210. The motor controller 211 controls a motor M1 for driving a conveyance roller within the image forming apparatus 100, a motor M2 for driving a conveyance roller within the first stacker 170*a*, or the like. The heater control unit 212 controls power supplied to the heaters 140 and 141 so that the fixing temperature of the heaters 140 and 141 becomes a target temperature. The target temperature is set by the fixing control unit 223 in accordance with the type of the sheet P, the presence or absence of gloss or a fixation mode designated by an operator, or the like. A thermistor for detecting the fixing temperature of the heaters 140 and 141 may be connected to the heater control unit 212. The I/O controller 213 receives sensor signals from the first fixation sensor 153, the second fixation sensor 163, the inversion sensor 137, or the like, and notifies the CPU 201 of the levels of the sensor signals. Actuators such as solenoids for controlling the first flapper 131 and the second flapper 132 are connected to the I/O controller 213. The I/O controller 213 switches the first flapper 131 and the second flapper 132 in accordance with control signals outputted from the CPU 201. The paper surface sensor 178 and the lower limit sensor 179 are connected to the I/O controller 213. The I/O controller 213 transfers detection signals of the paper surface sensor 178 and the lower limit sensor 179 to the CPU 201. The CPU 201 recognizes the position of the sheet P in relation to the discharge port 175 through the paper surface sensor 178. Also, the CPU 201 recognizes the position of the lift table 176 through the lower limit sensor 179. A media sensor 241 and a temperature sensor 242 are connected to the I/O controller 213. The media sensor 241 is a sensor that detects a property parameter (for example: a grammage, a thickness, a gloss) indicating the type of the sheet P. The temperature sensor 242 is a sensor for detecting the temperature of the environment (ambient temperature) in which the image forming apparatus 100 is installed.

<Sheet Conveyance Example>

Figure 3:
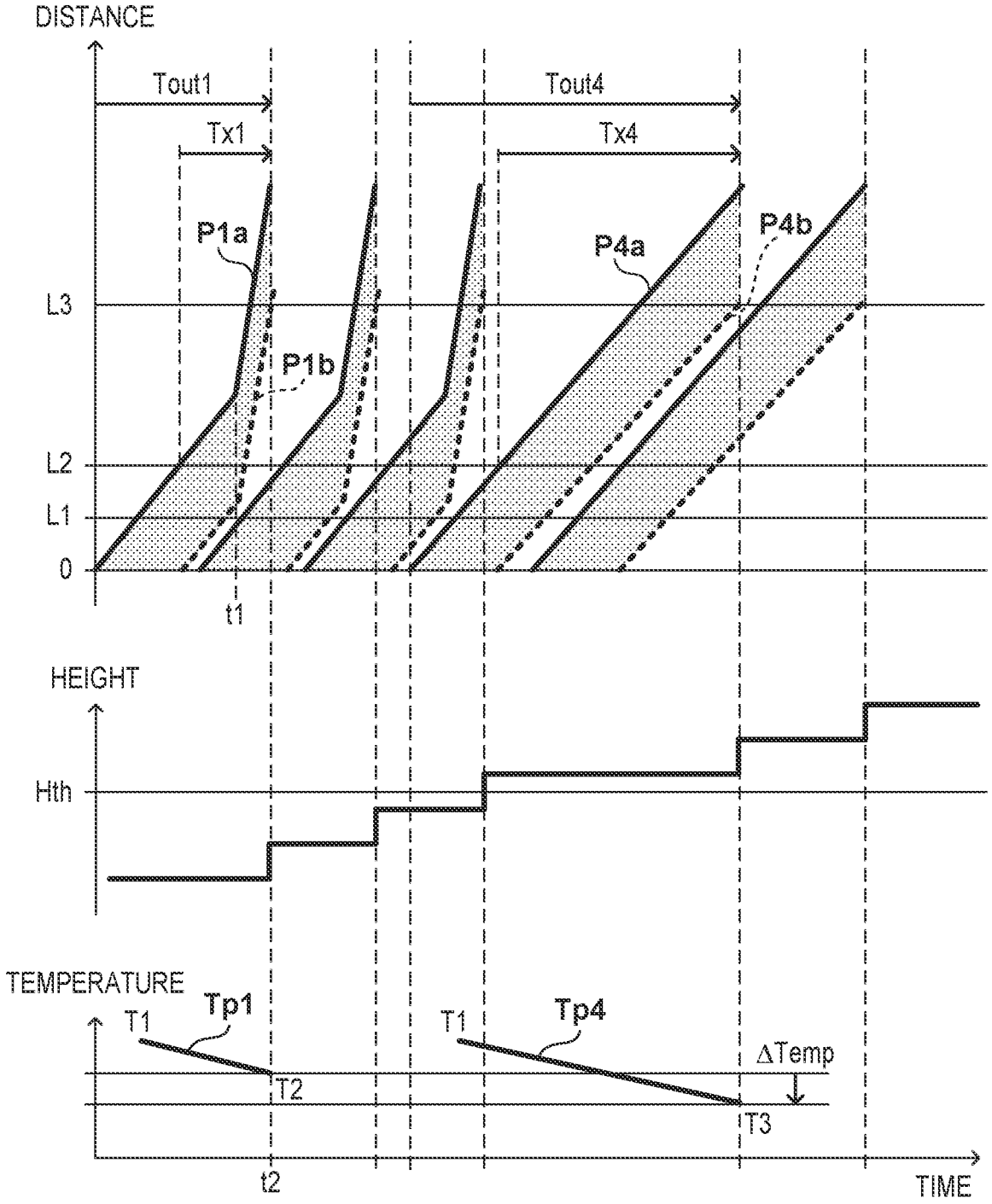
FIG. 3 is a view illustrating a sheet conveyance speed, a height of a pile of sheets, and a temperature of a sheet.

FIG. 3 is a view for describing operation of the image forming apparatus 100 which performs processing for reducing adhesion between sheets that are discharged. The abscissa indicates time. The ordinate indicates the conveyance distance from the secondary transfer body 114, the height of the pile of sheets stacked on the lift table 176*a*, and the temperature of the sheet P. Here, it is envisioned that images are formed at regular intervals on five sheets P1-P5. L1 is a conveyance distance from the secondary transfer body 114 to the second fixing device 160. L2 is a conveyance distance from the secondary transfer body 114 to the loading port 180*a*. L3 is a conveyance distance from the secondary transfer body 114 to the discharge port 175*a*. P1*a* indicates a track of the leading edge position of the first sheet P1. P1*b* indicates a track of a trailing edge position of the first sheet P1. P4*a* indicates a track of the leading edge position of the fourth sheet P4. P4*b* indicates a track of the trailing edge position of the fourth sheet P4. Tp1 indicates a temperature of the first sheet P1. Tp4 indicates a temperature of the fourth sheet P4. Tout1 is a time from when the leading edge of the sheet P1 is discharged from the secondary transfer body 114 until when the trailing edge of the sheet P1 reaches the discharge port 175*a*. Tx1 is a time from when the leading edge of the sheet P1 has passed the loading port 180*a* of the first stacker 170*a* until when the trailing edge of the sheet P1 reaches the discharge port 175*a*. Tout4 is a time from when the leading edge of the sheet P4 is discharged from the secondary transfer body 114 until when the trailing edge of the sheet P4 reaches the discharge port 175*a*. Tx4 is a time from when the leading edge of the sheet P4 has passed the loading port 180*a* of the first stacker 170*a* until when the trailing edge of the sheet P4 reaches the discharge port 175*a*.

As FIG. 3 illustrates, the conveyance control unit 224, at time t1, controls the motors M1 and M2 so that the conveyance speed V of the sheet P1 accelerates from the conveyance speed V1 to the conveyance speed V2 (V2>V1). By this, the waiting time of the operator is decreased, and usability is improved so that the operator is able to acquire the sheet P1 immediately. According to FIG. 3, the leading edge of the sheet P1 is conveyed at the conveyance speed V1 from the secondary transfer body 114 until part way through the conveyance path 171*a* of the first stacker 170*a*. The trailing edge of the sheet P1 is conveyed at the conveyance speed V1 until time t1. At time t1, the trailing edge of the sheet P1 is positioned between the second fixing device 160 and the loading port 180*a* of the first stacker 170*a*. The CPU 201 determines that image formation onto the sheet P1 has completed at time t2 at which the trailing edge of the sheet P1 reaches the discharge port 175*a* of the first stacker 170*a*. The conveyance control unit 224 lowers the lift table 176*a* by controlling the elevating mechanism 177*a*, and causes the height of the surface of the stacked sheet P1 to align with the height of the discharge port 175*a*.

Because a large amount of heat is supplied when the sheet P1 passes through the second fixing device 160, the temperature Tp1 of the sheet P1 reaches T1. After that, the heat of the sheet P1 dissipates as it is conveyed along the conveyance path 135, the conveyance path 171*a*, and the like. At time t2 when the trailing edge of the sheet P1 is discharged from the discharge port 175*a*, the temperature Tp1 of the sheet P1 has dropped down to T2 (T1>T2). Generally, the sheet P is formed of a material that tends to retain heat (example: paper fiber). In particular, heat stored within the paper fiber tends not to escape easily in cases where the sheet P is a thick paper, a coating layer is provided on the surface thereof, and a toner image to be formed uniformly over the entire surface of the sheet P. Also, there are cases in which many hot sheets P are stacked on the lift table 176*a*. There are cases in which, due to a tendency of heat not to dissipate and due to pressure from the sheets positioned above, the toner image formed on a sheet P in a lower position among the sheets stacked on the lift table 176*a* adheres to the back surface of a sheet P positioned immediately thereabove. Such a phenomenon of the toner image on a preceding sheet P adhering to the back surface of a succeeding sheet P is referred to as discharged paper adhesion. Note that with a face down discharge, the toner image on the succeeding sheet P will end up adhering to the back surface of a preceding sheet P. The toner image of the preceding sheet P and the toner image of the succeeding sheet P end up adhering with double-sided image formation.

Accordingly, the image forming system 1 has an adhesion reduction mode in which the time until the sheet P reaches the discharge port 175*a* is lengthened, and time over which the sheet P is in contact with the conveyance path 135 and the conveyance path 171*a* and over which heat dissipates is allocated. As FIG. 3 illustrates, the sheet P4 is conveyed to the discharge port 175*a* at the conveyance speed V1 without accelerating. By this, sufficient time for heat dissipation is allocated for the sheet P4. Also, since the time until the sheet P4 reaches the third sheet P3, which precedes the sheet P4 and is stacked on the lift table 176*a*, becomes longer, time for heat dissipation is allocated.

Various conditions can be considered as transition conditions (adhesion conditions) for the image forming system 1 to transition into the adhesion reduction mode in this way. The transition conditions and adhesion conditions may be referred to as stacking conditions. As FIG. 3 illustrates, a transition condition may be that the height of the pile of sheets stacked on the lift table 176*a* exceeds a threshold Hth. The threshold Hth may be referred to as a reference height (example: 200 mm). The conveyance control unit 224, based on the height of the pile of sheets obtained by the lower limit sensor 179*a* or the like, determines whether or not the transition condition is satisfied.

As FIG. 3 illustrates, the conveyance time Tx4 of the sheet P4 is longer than the conveyance time Tx1 of the sheet P1. The temperature Tp4 of the sheet P4 is also T1 when the second fixing device 160 is discharged. However, because Tx4>Tx1, the time for heat dissipation for the sheet P4 is longer as compared to the time for heat dissipation for the sheet P1. Consequently, the temperature Tp4 of the sheet P4 when the sheet P4 is stacked on the lift table 176*a* is reduced to T3. In other words, compared to the temperature Tp1 of the sheet P1, the temperature Tp4 of the sheet P4 is lower by ΔTemp. Accordingly, discharged paper adhesion is reduced.

In the case of a print job immediately after a job start whose stacking height will be low, discharged paper adhesion tends not to occur. Accordingly, the transition condition is not satisfied in such a case, and acceleration of the conveyance speed of the sheet P is enabled. In other words, the conveyance time of the sheet P is Tx1. By this, the operator is able to acquire the sheet P on which the toner image is formed quickly.

The conveyance control unit 224 in FIG. 3 maintains the conveyance speed V of the sheet P4 at V1, but it may be changed to V3 which is even slower than V1 (V2>V1>V3). By this, the conveyance time for the sheet P4 becomes even longer than Tx4. For example, if the type of the sheet P4 is a type for which heat tends not to dissipate particularly easily, the conveyance speed V3 may be applied. Note that the conveyance control unit 224 may also change the conveyance speed V of the sheet P4 to V4 which is faster than V1 (V2>V4>V1). For example, if the type of the sheet P4 is a type for which heat dissipates particularly easily, the conveyance speed V4 may be applied. As FIG. 3 illustrates, by maintaining the discharge speed of the sheet P4 at V1, an image interval (a so-called sheet interval) in the engine unit 101 is maintained. This shortens the time that the operator waits as compared to V3.

<Flowchart>

Job Control Unit 221

Figure 4:
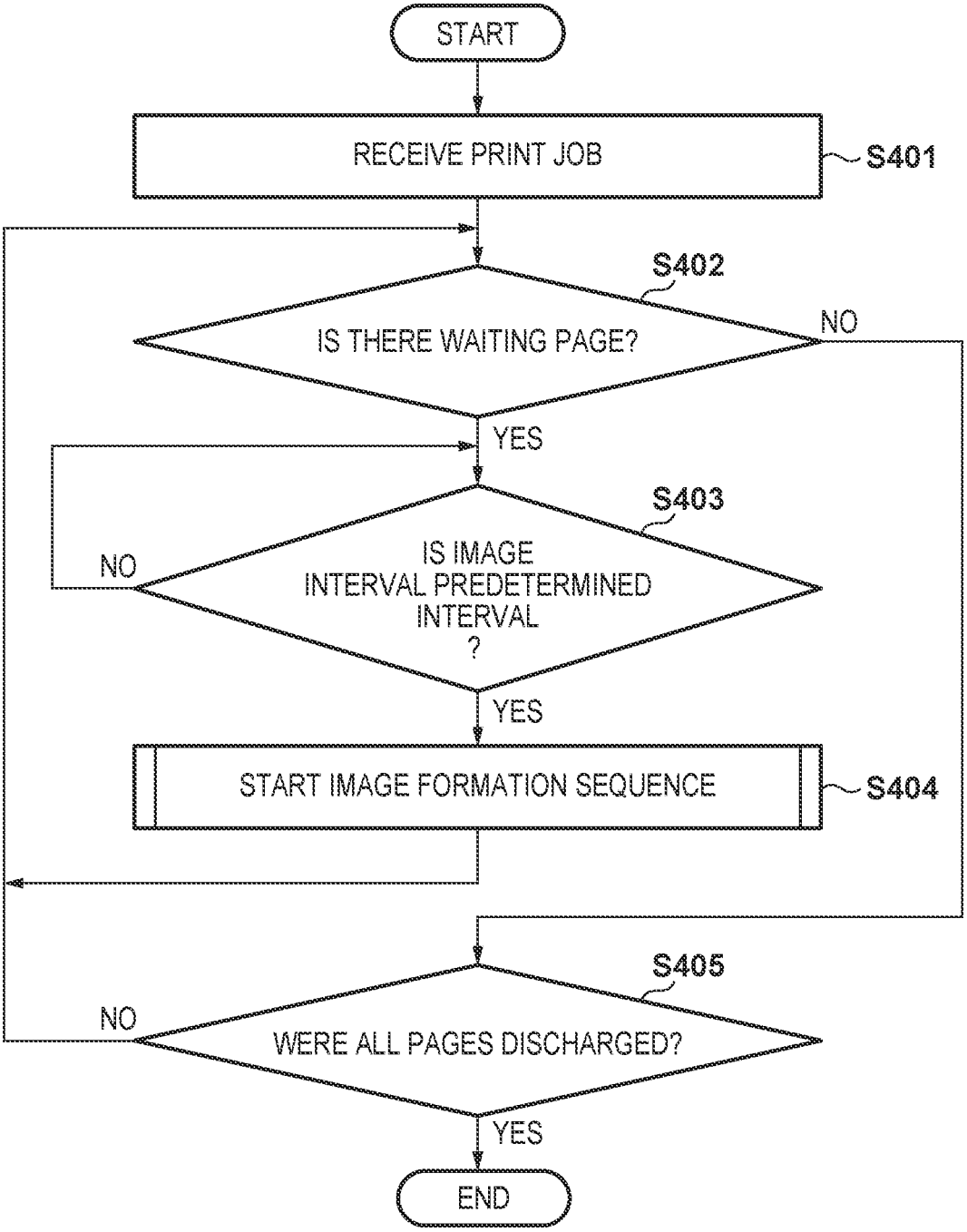
FIG. 4 is a flowchart illustrating a print job.

FIG. 4 is flowchart for describing steps that the CPU 201 (the job control unit 221) executes.

In step S401, the job control unit 221 receives a print job.

In step S402, the job control unit 221 determines whether or not there is a waiting page that is awaiting the start of image formation. For example, the job control unit 221 determines that there is a waiting page if the difference between the number of pages designated by the print job and the number of pages for which image formation has already completed is 0 or more. The job control unit 221 advances to step S403 if there is a waiting page. In this way, the job control unit 221 has a function as a waiting page determination unit.

In step S403, the job control unit 221 determines whether or not the image interval is a predetermined interval based on a count value of the timer 204. In this way, the job control unit 221 has a function as an image interval determination unit. The image interval is a time interval from the trailing edge of the toner image formed on a preceding sheet P in the secondary transfer body 114 until the leading edge of the toner image formed on a succeeding sheet P. The job control unit 221 advances to step S404 when the count value of the timer 204 reaches the predetermined interval.

The job control unit 221, in step S404, starts an image formation sequence by controlling the print control unit 222. So long as waiting pages remain, the job control unit 221 repeatedly executes step S402 through step S404. In step S402, when there ceases to be a waiting page, the job control unit 221 advances to step S405.

In step S405, the job control unit 221 determines whether or not all pages were discharged to a stacking unit such as the first stacker 170*a*. For example, the job control unit 221 may determine that all pages were discharged when the trailing edge of the sheet P of the final page in the print job is detected by the first fixation sensor 153 or the second fixation sensor 163. Also, the job control unit 221 may determine that all pages were discharged when it is detected that the sheet P of the final page was stacked on the lift table 176*a* by the paper surface sensor 178*a*.

Print Control Unit 222

Figure 5:
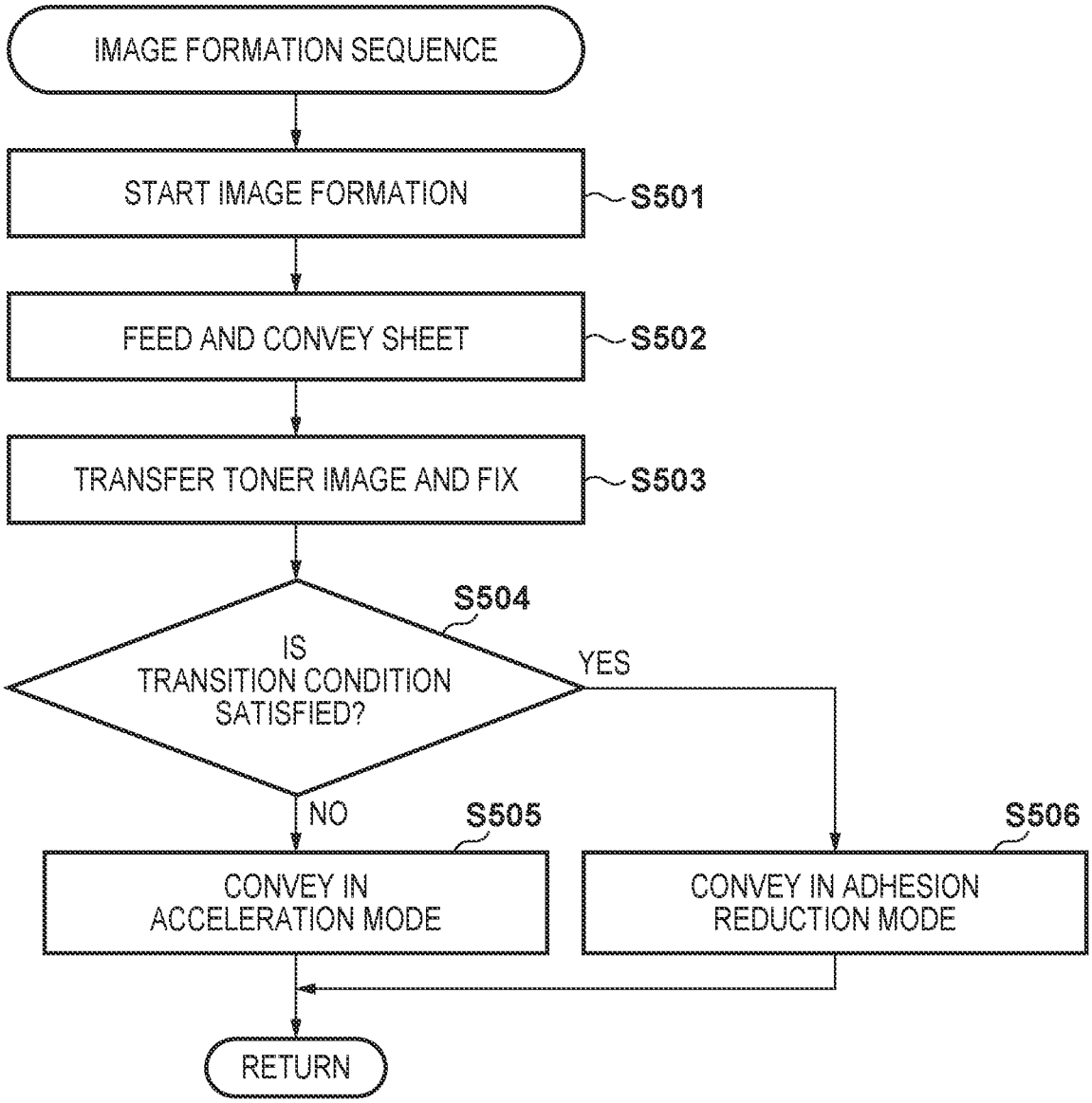
FIG. 5 is a flowchart illustrating an image formation sequence.

FIG. 5 is a flowchart for describing details of the image formation sequence of step S404. The image formation sequence is executed by the print control unit 222 which is controlled by the job control unit 221.

In step S501, the print control unit 222 starts image formation in accordance with a print start instruction from the job control unit 221. The print control unit 222 transmits a request to output an image signal to the job control unit 221, and outputs the image signal outputted from the job control unit 221 to the exposure unit 108. The exposure unit 108 forms an electrostatic latent image by outputting a laser beam in accordance with the image signal. The print control unit 222 converts the electrostatic latent image into a toner image by controlling the developer 112.

In step S502, the print control unit 222 causes the conveyance control unit 224 to start feeding and conveying a sheet P. The conveyance control unit 224 executes the feeding of the sheet P such that when the toner image conveyed by the intermediate transfer belt 106 reaches the secondary transfer body 114, the leading edge of the sheet P also reaches the secondary transfer body 114. Note that the print control unit 222 sets, to the first conveyance speed V1, the conveyance speed V of the sheet P according to the conveyance control unit 224. The conveyance control unit 224 controls the motor that drives the conveyance unit 102, the motor that drives the image carrier 105, the motor that drives the intermediate transfer belt 106 or the like such that the sheet P is conveyed at the conveyance speed V1 through the conveyance paths 109, 130A, and 130B.

In step S503, the print control unit 222 transfers the toner image to the sheet P by applying a transfer voltage to the secondary transfer body 114. Furthermore, the print control unit 222 causes the toner image to be fixed to the sheet P by supplying heat and pressure to the toner image and the sheet P by controlling the first fixing device 150 and the second fixing device 160 via the fixing control unit 223 and the heater control unit 212. The sheet P passes through the second fixing device 160 while being conveyed at the conveyance speed V1. The print control unit 222 advances to step S504 when it is detected that the trailing edge of the sheet P passes the second fixation sensor 163.

In step S504, the print control unit 222 determines whether or not the transition condition for the sheet P is satisfied. As described above, the transition condition is a condition for determining whether or not adhesion with another sheet P may occur for the sheet P. Also, since the transition condition defines a situation in which discharged paper adhesion tends to occur, it may also be referred to as an adhesion condition. For example, the following conditions can be considered for the transition condition.

(a) That the height of the pile of sheets stacked on the lift table 176*a* exceeds a reference height (a threshold Hth).

(b) That the stacker designated by the print job is a stacker that is close to the image forming apparatus 100 among a plurality of stackers.

(c) That a density of an image calculated by the job control unit 221 (example: a total amount of applied toner for one page or a unit area) is higher than a threshold density.

(d) That a property parameter which is a material, a thickness, or a grammage of the sheet P is a predetermined property parameter for which adhesion tends to occur.

(e) That the number of fixing devices through which the sheet P passes is greater than or equal to a threshold.

(f) That a heat amount supplied to the sheet P and the toner image by a fixing device is greater than or equal to a threshold.

(g) That a temperature of an environment in which the image forming apparatus 100 is installed is greater than or equal to a threshold.

Note that a plurality of transition conditions are listed here, but discharged paper adhesion tends to occur more when more transition conditions are satisfied. In the print control unit 222 may apply one among these transition conditions, and may apply two or more transition conditions. Also, the print control unit 222 may determine whether or not at least one transition condition among a plurality of transition conditions is satisfied (OR condition), and may determine whether or not two or more transition conditions among a plurality of transition conditions are satisfied (AND condition). The print control unit 222 advances to step S506 when it determines that a transition condition is satisfied. In this way, the print control unit 222 has a condition determination function.

In step S506, the print control unit 222 sets the conveyance mode of the conveyance control unit 224 to an adhesion reduction mode, and, in the conveyance path 139 and the conveyance path 171*a*, conveys the sheet P in the adhesion reduction mode. In the adhesion reduction mode, the conveyance speed V of the sheet P is set to a conveyance speed that is slower than V2 (example: V1, V3, V4). In this way, the print control unit 222 has a mode setting determination function.

Meanwhile, the print control unit 222 advances to step S505 when it determines in step S504 that a transition condition is not satisfied. The print control unit 222 sets the conveyance mode of the conveyance control unit 224 to an acceleration mode, and, in the conveyance path 139 and the conveyance path 171*a*, conveys the sheet P in the acceleration mode. In the acceleration mode, the conveyance speed V of the sheet P is set to V2.

Note that the conveyance mode is applied to both the first stacker 170*a* and the second stacker 170*b*. In other words, the first stacker 170*a* and the second stacker 170*b* each convey the sheet P in the adhesion reduction mode when it is designated by the print job that the second stacker 170*b* is the sheet discharging destination and the transition condition is satisfied. The first stacker 170*a* and the second stacker 170*b* each convey the sheet P in the acceleration mode when the transition condition is not satisfied, even if it is designated by the print job that the second stacker 170*b* is the sheet discharging destination. Accordingly, the sheet P is conveyed to and stacked in the second stacker 170*b*.

Transition Condition Determination Processing

Figure 6:
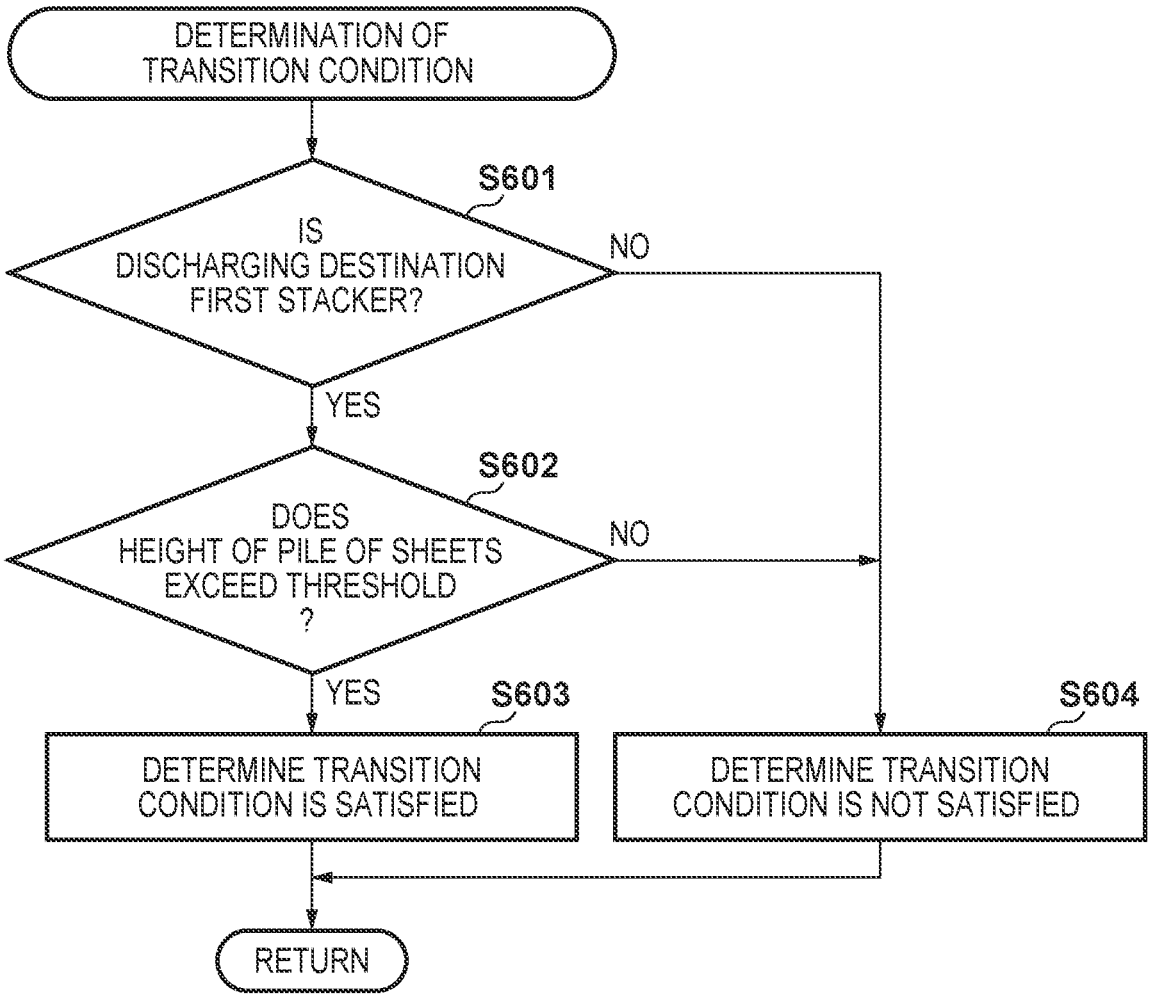
FIG. 6 is a flowchart illustrating processing for determining a transition condition.

FIG. 6 is a flowchart for describing transition condition determination processing which is executed by the print control unit 222. This determination processing corresponds to step S504. The transition condition here is an AND condition formed by combining two sub conditions (a) and (b) described above.

In step S601, the print control unit 222 analyzes a print job, and determines whether the discharging destination of the sheet P is the lift table 176*a* of the first stacker 170*a*. In this way, the print control unit 222 has a discharging destination determination function. If the discharging destination of the sheet P is not the first stacker 170*a*, the print control unit 222 advances to step S604.

The print control unit 222 determines in step S604 that the transition condition is not satisfied.

On the other hand, if the discharging destination of the sheet P is the first stacker 170*a*, the print control unit 222 advances to step S602.

In step S602, the print control unit 222 determines whether or not the height of the pile of sheets exceeds the threshold (example: 200 mm). In this way, the print control unit 222 has a threshold determination function. If the height of the pile of sheets exceeds the threshold, the print control unit 222 advances to step S603, and determines that the transition condition is satisfied. Meanwhile, if the height of the pile of sheets does not exceed the threshold, the print control unit 222 advances to step S604, and determines that the transition condition is not satisfied.

As described above, the height of the pile of sheets is calculated from a detection result by the lower limit sensor 179*a*, a detection result by the paper surface sensor 178*a*, and an up/down movement amount of the lift table 176*a*. More specifically, the conveyance control unit 224 causes the lift table 176*a* to be lowered until the lower limit sensor 179*a* detects the bottom surface of the lift table 176*a*. The conveyance control unit 224 resets the counter of the print control unit 222 and causes the lift table 176*a* to rise when the lower limit sensor 179*a* detects the bottom surface of the lift table 176*a*. The conveyance control unit 224 calculates the height of the pile of sheets from the count value when the paper surface sensor 178*a* detects the sheet stacking surface of the lift table 176*a* or the sheet P. Note that a function or table for converting the count value into the height of the pile of sheets may be stored in the ROM 202. Note that in place of the lower limit sensor 179*a* and the paper surface sensor 178*a*, a distance sensor that measures the distance to the bottom surface of the lift table 176*a* may be applied. The distance sensor, for example, has a light-emitting element and a light-receiving element. The distance sensor may convert the time from when the light-emitting element outputs light until when that light reflects off of the bottom surface of the lift table 176*a* and is incident on the light-receiving element into a distance. That distance will be inversely proportional to the height of the pile of sheets. The conveyance control unit 224 may convert a distance into the height of the pile of sheets. The conveyance control unit 224 reports the height of the pile of sheets to the print control unit 222.

CONCLUSION

The conveyance unit 102 is one example of a first conveyance unit that conveys a sheet P at a first conveyance speed (example: V1). The engine unit 101 is one example of an image forming unit that forms a toner image on a sheet P that is conveyed at a first conveyance speed (example: V1) by the conveyance unit 102. Note that the engine unit 101 encompasses mechanisms from the storage 113 to the second fixing device 160. Note that the conveyance rollers present from the second fixing device 160 until the discharge port of the conveyance path 139 form a discharge conveyance mechanism that is driven by the motor M1. The conveyance speed in the discharge conveyance mechanism may be referred to as a discharge speed. The motors M1 and M2 are one example of a second conveyance unit that conveys a sheet P discharged from the engine unit 101. The first stacker 170*a* and the second stacker 170*b* are one example of a stacking unit that stacks a sheet that was conveyed by the motors M1 and M2. The CPU 201, in a case where the sheet stacking condition of the stacking unit does not satisfy a predetermined stacking condition, controls the second conveyance unit to convey a sheet discharged from the image forming unit at a second conveyance speed that is faster than the first conveyance speed. On the other hand, the CPU 201, in a case where the sheet stacking condition of the stacking unit satisfies the predetermined stacking condition, controls the second conveyance unit to convey a sheet discharged from the image forming unit at a third conveyance speed that is slower than the second conveyance speed. In this way, the CPU 201 is one example of a control unit. The CPU 201, when the sheet P does not satisfy the transition condition (adhesion condition), sets the discharge speed of the sheet P to a second conveyance speed (example: V2) which is faster than the first conveyance speed by controlling the motors M1 and M2, and causes the motors M1 and M2 to convey the sheet P. The CPU 201, when the sheet P satisfies the adhesion condition, sets the discharge speed of the sheet P to a third conveyance speed (example: V1, V3, V4) which is slower than the second conveyance speed by controlling the motors M1 and M2, and causes the motors M1 and M2 to convey the sheet P. Note that the adhesion condition is one example of a sheet stacking condition. For example, the adhesion condition is a condition in which a sheet will adhere via a toner image to another sheet (preceding sheet) stacked in the stacking unit prior to that sheet or another sheet (succeeding sheet) that is stacked in a stacking unit after that sheet. In this way, in a situation in which discharged paper adhesion may occur, the conveyance speed is reduced in order to lengthen a time for heat dissipation of the sheet P (cooling time). By this, it becomes possible to reduce discharged paper adhesion without providing a plurality of parallel (redundant) conveyance paths. In other words, discharged paper adhesion is reduced effectively. Note that the conveyance path 171 is one example of a single conveyance path that is present from a discharge port of the image forming apparatus 100 until the discharge port 175*a* of the first stacker 170*a*.

The third conveyance speed is the same as the first conveyance speed or slower than the first conveyance speed. As FIG. 3 illustrates, by making the conveyance speed in the engine unit 101 and the conveyance speed in the first stacker 170*a* the same, the cooling time is lengthened, and the discharged paper adhesion is reduced. Note that in a case such as when the type of the sheet P (media attribute) is coated paper and thick paper, the conveyance speed in the first stacker 170*a* (example: V4) may be set to be slower than the conveyance speed in the engine unit 101 (example: V1). By this, discharged paper adhesion is reduced even for a sheet P of a type that does not dissipate heat easily.

The lower limit sensor 179*a*, the paper surface sensor 178*a*, and the CPU 201 are one example of a detection unit that detects the height of the pile of sheets stacked in the stacking unit. In such a case, the adhesion condition may include that the height of the pile of sheets, which is detected by the detection unit, exceeds a reference height (threshold Hth). Specifically, the CPU 201, if the detected height is less than or equal to the threshold, accelerates the sheet P to the second conveyance speed which is faster than the first conveyance speed by controlling the motors M1 and M2, and causes the motors M1 and M2 to convey the sheet P. Also, the CPU 201, if the detected height exceeds the threshold, causes the sheet P to be conveyed at a third conveyance speed slower than the second conveyance speed by controlling the motors M1 and M2. The more the number of sheets P that are stacked on the lift table 176*a* increases, the more difficult heat dissipation in the sheet P becomes. Accordingly, the above described adhesion reduction mode may be applied when the height of the pile of sheets exceeds the threshold Hth. The first stacker 170*a* may have the lift table 176*a* and an elevating unit. The elevating mechanism 177*a* is one example of an elevating unit that, by causing the lift table 176*a* to move up or down, keeps the position of the sheet positioned topmost among the sheets P stacked on the lift table 176*a* at a predetermined position. The lower limit sensor 179*a*, the paper surface sensor 178*a*, and the CPU 201 may function as a detection unit that detects the position of the lift table 176*a* or that detects the height of the pile of sheets by detecting an amount of up/down movement of the elevating mechanism 177*a*.

The stacking unit may have a plurality of stacking units. The first stacker 170*a* and the second stacker 170*b* are one example of a plurality of stacking units. In such a case, the adhesion condition may include that a sheet P is to be stacked in a stacker that is close to the engine unit 101 among a plurality of stackers (example: the first stacker 170*a*). Configuration may be such that an adhesion condition is defined by such a sub condition only. The operator designates one stacker as the discharging destination in the print job. A cooling effect on the sheet P increases in proportion to a conveyance distance from the engine unit 101 to the stacker. In other words, the closer the stacker is to the engine unit 101, the smaller the cooling effect on the sheet P becomes. Accordingly, the adhesion reduction mode may be applied in a case where a stacker that is close to the engine unit 101 is designated as the discharging destination.

The job control unit 221 is one example of a determination unit that determines whether or not the sheet stacking condition of the stacking unit satisfies a predetermined stacking condition. For example, the job control unit 221 may function as an obtainment unit that obtains a density of a toner image formed on a sheet P (an amount of applied toner). The job control unit 221 calculates the amount of applied toner for each of a plurality of pixels that configure the image data by analyzing the image data. By this, the job control unit 221 may determine whether or not discharged paper adhesion will occur easily for a toner image. In other words, the adhesion condition may also be that the obtained density is higher than a threshold density. The threshold density is a target for determining whether or not discharged paper adhesion will occur easily for a toner image, and is decided by experimentation or simulation in advance. The adhesion reduction mode may be applied when it is detected that discharged paper adhesion will occur easily for a toner image.

The media sensor 241 is one example of a detection unit that detects a property parameter which is a material, thickness, or grammage of the sheet P. In such a case, the adhesion condition may include that the property parameter detected by the media sensor 241 is a predetermined property parameter. Heat capacity of a sheet P that is thick and whose surface is coated is particularly large. Accordingly, discharged paper adhesion will occur easily for a sheet P with such a media attribute. Thus, the adhesion reduction mode may be applied when a sheet P of such a type is detected. Note that the print control unit 222 may determine whether or not the thickness of the sheet P detected by the media sensor 241 is greater than or equal to a threshold. Also, the print control unit 222 may determine whether or not the grammage of the sheet P detected by the media sensor 241 is greater than or equal to a threshold. The thresholds are decided by experimentation or simulation in advance.

The image forming apparatus 100 typically has one fixing device, but may have a plurality of fixing devices as illustrated in FIG. 1. In such a case, the adhesion condition may include that the number of fixing devices that the sheet P passes through is greater than or equal to a predetermined number (threshold). Generally, the temperature of the sheet P increases in proportion to the number of fixing devices through which the sheet P has passed, and so the possibility that discharged paper adhesion will occur increases. The adhesion reduction mode may be applied if the number of fixing devices through which the sheet P has passed is greater than or equal to a threshold.

Accordingly, there are cases in which the fixing device has a plurality of fixation modes whose fixing temperature or heat amount respectively differ. In such a case, the print control unit 222 may apply the adhesion reduction mode when a fixation mode in which discharged paper adhesion will occur easily is designated among the plurality of fixation modes. In other words, the adhesion condition may include that the heat amount supplied to the sheet and the toner image in the fixing device is greater than or equal to a threshold. In such a case, the threshold is decided by experimentation or simulation in advance.

The temperature sensor 242 is one example of a detection unit for detecting the temperature of the environment in which the image forming apparatus 100 is installed. In such a case, the adhesion condition may include that the temperature detected by the temperature sensor 242 is greater than or equal to a threshold. The higher an ambient temperature of the image forming apparatus 100 is, the easier it is for discharged paper adhesion to occur. Accordingly, the adhesion reduction mode may be applied when the ambient temperature is greater than or equal to a threshold.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-035111, filed Feb. 27, 2017 which is hereby incorporated by reference herein in its entirety.

What is claimed is:

1. An image forming apparatus comprising:

a first conveyance unit configured to convey a sheet at a first conveyance speed;

an image forming unit configured to form a toner image on the sheet conveyed at the first conveyance speed by the first conveyance unit;

a second conveyance unit configured to convey the sheet discharged from the image forming unit;

a stacking unit configured to stack the sheet conveyed by the second conveyance unit; and a control unit configured to control, in a case where a sheet stacking condition of the stacking unit does not satisfy a predetermined stacking condition, the second conveyance unit to convey the sheet at a second conveyance speed that is faster than the first conveyance speed, and in a case where the sheet stacking condition of the stacking unit satisfies the predetermined stacking condition, the second conveyance unit to convey the sheet at a third conveyance speed that is slower than the second conveyance speed.

2. The image forming apparatus according to claim 1, wherein the third conveyance speed is the same as the first conveyance speed or slower than the first conveyance speed.

3. The image forming apparatus according to claim 1, further comprising a detection unit configured to detect a height of a pile of sheets stacked in the stacking unit, wherein the control unit determines that the sheet stacking condition of the stacking unit satisfies the predetermined stacking condition in a case where the height of the pile of sheets detected by the detection unit exceeds a reference height.

4. The image forming apparatus according to claim 3, wherein the stacking unit includes:

a lift table operable to stack the sheet and move up or down, and an elevating unit configured to, by causing the lift table to move up or down, keep a position of a sheet positioned topmost among sheets stacked on the lift table at a predetermined position, and wherein the detection unit detects a height of the pile of sheets by detecting a position of the lift table or detecting an up/down movement amount of the elevating unit.

5. The image forming apparatus according to claim 1, wherein the stacking unit has a plurality of stacking units, and wherein the control unit determines that the sheet stacking condition of the stacking unit satisfies the predetermined stacking condition in a case where the sheet is to be stacked in a stacking unit that is close to the image forming unit among the plurality of stacking units.

6. The image forming apparatus according to claim 1, further comprising an obtainment unit configured to obtain a density of an image to be formed on the sheet, wherein the control unit determines that the sheet stacking condition of the stacking unit satisfies the predetermined stacking condition in a case where the density obtained by the obtainment unit is higher than a threshold density.

7. The image forming apparatus according to claim 1, further comprising a detection unit configured to detect a property parameter which is a material, a thickness, or a grammage of the sheet, wherein the control unit determines that the sheet stacking condition of the stacking unit satisfies the predetermined stacking condition in a case where the property parameter detected by the detection unit is a predetermined property parameter.

8. The image forming apparatus according to claim 1, wherein the image forming unit has a plurality of fixing devices for causing the sheet to be fixed by adding heat to a toner image, and wherein the control unit determines that the sheet stacking condition of the stacking unit satisfies the predetermined stacking condition in a case where the sheet is to be stacked on the stacking unit after having passed through more than a predetermined number of fixing devices.

9. The image forming apparatus according to claim 1, wherein the image forming unit has a fixing device for causing the sheet to be fixed by adding heat to the sheet and a toner image, and wherein the control unit determines that the sheet stacking condition of the stacking unit satisfies the predetermined stacking condition in a case where a heat amount supplied to the sheet and the toner image in the fixing device is greater than or equal to a threshold.

10. The image forming apparatus according to claim 1, further comprising a detection unit configured to detect a temperature of an environment in which the image forming apparatus is installed, wherein the control unit determines that the sheet stacking condition of the stacking unit satisfies the predetermined stacking condition in a case where the temperature detected by the detection unit is higher than a threshold.

11. The image forming apparatus according to claim 1, wherein the image forming unit includes:

an image carrier, a charging unit configured to uniformly charge the image carrier, an exposure unit configured to form an electrostatic latent image by exposing the image carrier, a developer unit configured to form a toner image by developing an electrostatic latent image using toner, a transfer unit configured to transfer the toner image to the sheet, and a fixing unit configured to cause the toner image to be fixed to the sheet by adding heat to the toner image and the sheet.

12. The image forming apparatus according to claim 1, wherein the control unit further has a determination unit configured to determine whether or not the sheet stacking condition of the stacking unit satisfies the predetermined stacking condition.

13. An image forming system comprising:

a first conveyance unit configured to convey a sheet at a first conveyance speed;

an image forming apparatus configured to form a toner image on the sheet conveyed at the first conveyance speed by the first conveyance unit;

a stacking apparatus connected to the image forming apparatus and configured to stack a sheet that the image forming apparatus discharges; and a control unit configured to control the image forming apparatus and the stacking apparatus, wherein the image forming apparatus comprises:

an image carrier, a charging unit configured to uniformly charge the image carrier, an exposure unit configured to form an electrostatic latent image by exposing the image carrier, a developer unit configured to form a toner image by developing an electrostatic latent image using toner;

a transfer unit configured to transfer the toner image to the sheet, and a fixing unit configured to cause the toner image to be fixed to the sheet by adding heat to the toner image and the sheet, and wherein the stacking apparatus comprises:

a second conveyance unit configured to convey the sheet discharged from the image forming apparatus, and a stacking unit configured to stack the sheet conveyed by the second conveyance unit, and wherein the control unit is configured to control, in a case where a sheet stacking condition of the stacking unit does not satisfy a predetermined stacking condition, the second conveyance unit to convey the sheet at a second conveyance speed that is faster than the first conveyance speed, and in a case where the sheet stacking condition of the stacking unit satisfies the predetermined stacking condition, the second conveyance unit to convey the sheet at a third conveyance speed that is slower than the second conveyance speed.

14. The image forming system according to claim 13, wherein the conveyance path from the discharge port of the image forming apparatus to the stacking unit is a single conveyance path.

15. An image forming apparatus comprising:

a first conveyance unit configured to convey a sheet at a first conveyance speed;

an image forming unit configured to form a toner image on the sheet conveyed at the first conveyance speed by the first conveyance unit;

a second conveyance unit configured to convey the sheet discharged from the image forming unit;

a stacking unit configured to stack the sheet conveyed by the second conveyance unit;

a detection unit configured to detect a height of a pile of sheets stacked in the stacking unit; and a control unit configured to, in a case where the height detected by the detection unit is less than or equal to a threshold, control the second conveyance unit to accelerate the sheet to a second conveyance speed that is faster than the first conveyance speed, and, in a case where the height detected by the detection unit exceeds the threshold, control the conveyance unit to convey the sheet to a third conveyance speed that is slower than the second conveyance speed.

* * * * *